United States Patent [19]

Hale

[11] Patent Number: 4,636,114

[45] Date of Patent: Jan. 13, 1987

[54] BUOYANCY-SUPPORTED STRUTS FOR OCEAN PLATFORMS

[75] Inventor: Neville E. Hale, Mississauga, Canada

[73] Assignee: Fathom Oceanology Limited, Mississauga, Canada

[21] Appl. No.: 651,842

[22] Filed: Sep. 18, 1984

[30] Foreign Application Priority Data

Sep. 23, 1983 [CA] Canada ..... 437397

[51] Int. Cl.[4] ..... E02D 5/74; E21B 7/12; E02B 17/08

[52] U.S. Cl. ..... 405/224; 405/195; 166/367

[58] Field of Search ..... 405/195, 197, 200, 203-206, 405/224, 209; 166/359, 351, 367; 175/7; 114/264, 265

[56] References Cited

U.S. PATENT DOCUMENTS

| | | | |
|---|---|---|---|
| 2,552,899 | 5/1951 | Manes | 405/206 |
| 3,017,934 | 1/1962 | Rhodes et al. | 175/7 X |
| 3,091,937 | 6/1963 | Thompson et al. | 405/204 |
| 3,717,002 | 2/1973 | O'Brien et al. | 405/170 |
| 3,858,401 | 1/1975 | Watkins | 175/7 X |
| 3,981,357 | 9/1976 | Walker et al. | 175/7 X |
| 4,094,162 | 6/1978 | Allee | 405/204 |
| 4,297,965 | 11/1981 | Horton et al. | 114/265 |
| 4,403,658 | 9/1983 | Watkins | 166/367 X |
| 4,468,157 | 8/1984 | Horton | 405/224 |

FOREIGN PATENT DOCUMENTS

| | | | |
|---|---|---|---|
| 1519203 | 7/1978 | United Kingdom | 166/367 |
| 2058887 | 4/1981 | United Kingdom | 166/367 |

*Primary Examiner*—Cornelius J. Husar
*Assistant Examiner*—Nancy J. Stodola
*Attorney, Agent, or Firm*—Donald E. Hewson

[57] ABSTRACT

Buoyancy apparatus is provided which allows two or more air canisters (43,45) to be mounted one above the other on a section (7) of a strut, without touching the delicate sides of the highly stressed part of that strut section. The canisters need not be of the same length as the section, and each may be of a length determined by the differing manufacturing economies of each. By removing this manufacturing restraint, it is economically possible to produce a strut in the form of a practical tether for a tension-leg platform for deep ocean use. The buoyancy canisters are held in place by tension cords (54,56,58) which attach flotation abutment plates (57,59) to a bulbous and relatively unstressed end (8) of the strut section. The strut, together with its buoyancy, may be deployed by screwing the strut sections one to another.

15 Claims, 7 Drawing Figures

FIG 6
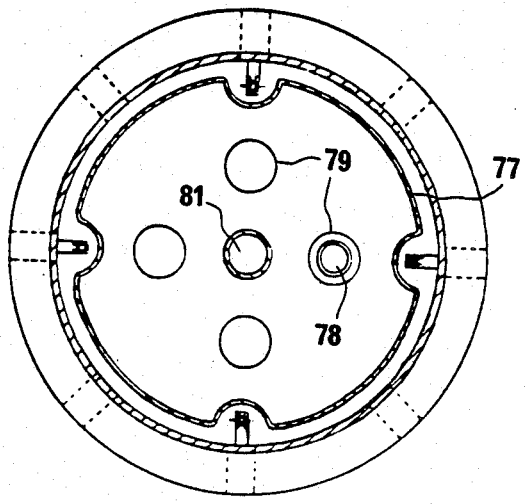
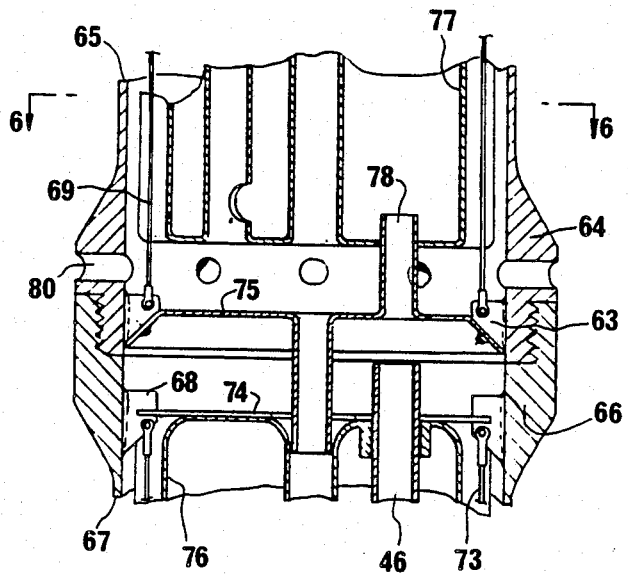
FIG 5

BUOYANCY-SUPPORTED STRUTS FOR OCEAN PLATFORMS

FIELD OF THE INVENTION

This invention relates to means for providing buoyancy on structures that extend down to great ocean depths.

In order to look for, and to recover, resources beneath the ocean, it is usually necessary to provide a strut or similar structure that can convey mechanical force between the surface and the ocean bed. That force may be a rotary force, associated with a drilling operation, or it may be a tensile force, associated with anchoring a ship or platform above a point on the ocean bed. It may also be a compressive force, such as is associated with a tower on which rests a working platform.

When the force-supporting strut is very long (i.e., when the water is deep) a large proportion of the strength of the strut can go in holding up its own weight. The longer the strut, the less strength it has left over to support any useful forces.

PRIOR ART

It is known to provide air buoyancy systems to support the weight of the strut, leaving the strength of the strut available for useful force transmission purposes. Such a system is that shown in HALE, et al, Canadian Pat. No. 1,136,545, issued Nov. 30, 1982. Briefly, this system involves the placing of a large number of hollow canisters along the height or length of the strut. Each canister is effectively open at the bottom, and closed at the top.

The canister is provided with a tube that has a port near the bottom of the canister. When the canister is almost full of air (so that the water in it is almost completely expelled) the port becomes uncovered and further air fed into the canister enters the tube. This extra air is received into the tube and directed by its pipe to a point from which it bubbles up into the next canister above. Air fed into the bottom-most of a vertical series of canisters therefore fills each canister in turn, in cascade from the bottom up.

A huge advantage of this system is that the air pressure in each canister is the same as that of the water that surrounds it; each canister, whatever its depth, can therefore be a mere container and not a pressure vessel. So long as air is initially pressurized sufficiently to force it against the water pressure into the bottom-most canister, air will cascade up through all the canisters in the manner described, and its pressure will be automatically equalized with that of the water at every one of them.

BACKGROUND OF THE INVENTION

The pressure of water varies with the depth of the water, but the pressure of air is substantially not dependent on depth. This fact gives rise to a limitation on this "cascading-canister" system (more generally known now as the CASCAN (TM) system) and that is that, for the structure of each canister to be relatively unstressed, the individual canisters should be quite short in height. It is only at the level where the water actually contacts the air that the air and water pressures are exactly equal. If the canister were for example 10 meters high, then there would be a pressure difference between the air inside the top of the canister and the water outside the top of the canister of around one atmosphere, and the walls of the canister would have to be strong enough not to explode under that pressure.

Another reason why the canister should be short is that the canister must be airtight. The bigger the canister, the more difficult a production problem there may be to ensure the integrity of the structure.

Each section of the strut should have its own weight supported by the canister or canisters of air associated with that section. In other words, the sections of the strut should each be neutrally buoyant. Steel has a density of about seven and a half times that of the (salt) water that is to be displaced by the air. In the case therefore where the canister is only, say, half the height of the section, the cross-sectional area of the air space in the canister will have to be fifteen times as large as the cross-sectional area of the steel.

A canister as wide as that is too bulky to be economically manufactured. If one uses more than one canister, the problems on the ship, during deployment of the strut, of mounting the canisters to the sections are too much. The problem arises because it is not economically permissible to make attachments to the steel of the strut section at any point in the section other than right at the ends. It is acceptable to make attachments at the ends since the ends have to be formed with bulbous flanges in any case because of the joints. The main part of the length of the section is slender, and highly stressed. Its surface has an anti-corrosion coating that is to be carefully examined for scratches and cracks and other imperfections or damage to the coating that could be stress-concentration points or give rise to other problems. It is only at the bulbous ends that these precautions can be relaxed and, for example, holes made in the steel. The canisters should not even be allowed to chafe against the surface coating, and clamp-on collars are not permissible either.

One could conceive of using a flange at the bulbous junction, and allowing a canister to float up underneath and against the flange, and then allowing another canister to float up underneath and against the first canister. This too is unacceptable, because the buoyancy upthrust of the lower canister could crush the upper canister.

Virtually all these problems of manufacture and of ensuring a long reliable life of the canisters and the sections might be overcome if it were economical to make the components thicker, stronger, and larger. However, there is yet a further very difficult problem, and that is the problem of the speed of deployment of the strut. A strut is deployed section by section from a ship, the strut gradually becoming longer until it touches the bottom. Good weather is needed throughout assembly, as it is not economically permissible to break off before deployment of the strut is finished. The predictable weather window is small, and assembly and installation must be finished within it. The speed at which the sections can be hoisted into position, joined, and the canisters added, is therefore critical.

It has been found not to be economically possible using conventional methods to produce a tensile strut by which a platform may be tethered to the sea bed, because of the problems outlined above. Tension leg platforms (TLP's) however, are thought by many to be the best basis for the future exploitation of undersea resources in very deep water, if only the tensile struts, or tethers, could be economically made and deployed.

BRIEF DESCRIPTION OF THE INVENTION

The present invention is aimed at making possible the economical manufacture and deployment of a strut that is in joined-together sections, each section being made substantially neutrally buoyant by means of air canisters arranged in CASCAN fashion, when the strut particularly is a tensile strut for a tether of a TLP.

In the invention, each canister has a height of less than half the height of a section of the strut, and there are normally two canisters per section, or as many more as can be accommodated per section. The canisters are attached to the sections, and apply their buoyancy forces to the sections, by means of tension cords that are attached to attachment points at a bulbous end of the section. The tension cords may be secured directly or indirectly, which is to say that a cord may run directly from the attachment point on the bulbous end of the section to an attachment point such as a lug on the canister. Or alternately, cords may run from the bulbous end to a lower canister, and further cords may run from the lower canister to an upper canister, so that the buoyancy of the upper canister is transmitted indirectly, i.e., through the lower canister, to the bulbous end below; it being recognized by the invention that whilst a canister would tend to crumple if subject to the buoyancy force of another canister in compression, it can easily support that same force in tension. Or, as a further alternative cords may run from the bulbous end to a support frame above the canister, arranged so that the canister floats up against the support frame: again, such frames can be linked vertically by other cords so the buoyancy of upper canisters is transmitted indirectly to the bulbous end below. When the transmission of the buoyancy is indirect, the cords actually directly attached to the bulbous end carry the buoyancy forces of more than one canister.

As will be seen from the embodiments described below, the air canister may be annular, and suspended surrounding a solid column of steel; or the strut may be a steel section that is a hollow tube with the air canister disposed inside the hollow interior. In either case, the volume of air (i.e., of displaced water) should be about seven and a half times the volume of the steel: with the manner of suspending the canisters as in the invention, the height of the section's air-envelope can be almost the same as the height of the section. This means that the cross-sectional area of the air-envelope can be a minimum. The manufacture of struts with either solid and hollow sections is now economically viable with the configurations of canister layout permitted by the invention.

Not only that, but the manner of suspending the canisters as in the invention is conducive to fast and easy deployment of the strut. As a steel section of the strut is lowered into the water, its upper end is gripped by jaws. The next steel section is picked up from the deck, placed end to end, and screwed tight using another pair of jaws. If the canisters are to surround the steel, each canister can be donut shaped (in pla n view) and can be easily lowered over its section at this point. If the section is hollow and the canisters are to go inside the steel, the canister again can be simply lowered into place. Hose connections are needed for conveying the flotation air to the lowermost canister from a compressor at the surface, and these connections can be made at a convenient point in the deploying operation.

A feature of the manner of suspension of the canisters and the manner of their deployment in the invention is that the canisters need never touch the vulnerable and delicate coated surface of the highly stressed part of the section since the canister is only assembled to the section when both are hanging vertically.

Further tension cords may hang downwards from the bulbous end of a section to take the weight of the canisters during deployment, before the canisters become submerged; these cords then go slack, as the canisters become buoyant. It may be arranged that the canisters are not filled with air until the whole strut has been deployed, or it may be arranged that they are charged with air either section by section, or for instance every ten sections, or to suit.

DETAILED DESCRIPTION OF PREFERRED EMBODIMENTS

Exemplary embodiments of the invention will now be described, with reference to the accompanying drawings, in which:

FIG. 5 is a close-up of part of a tether similar to that of FIG. 4; but slightly modified;

FIG. 6 is sectional view on line 6—6 of FIG. 5; and

DESCRIPTION OF THE CONSTRUCTIONAL DETAILS

Figure 1:
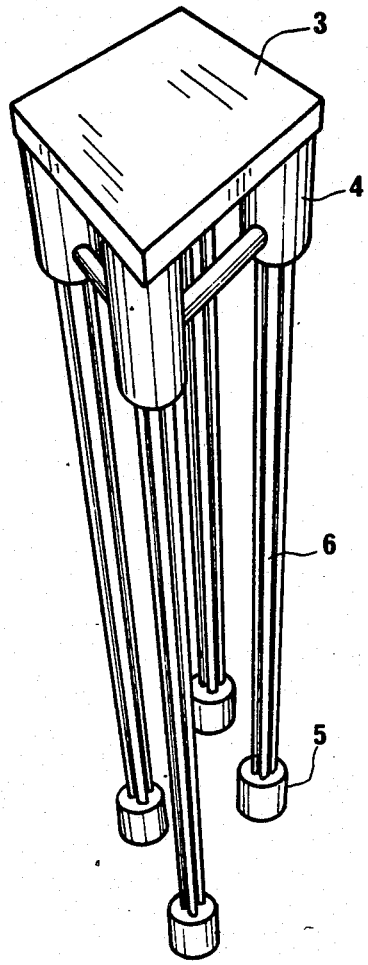
FIG. 1 is a pictorial view of a tension-leg-platform.
Figure 3:
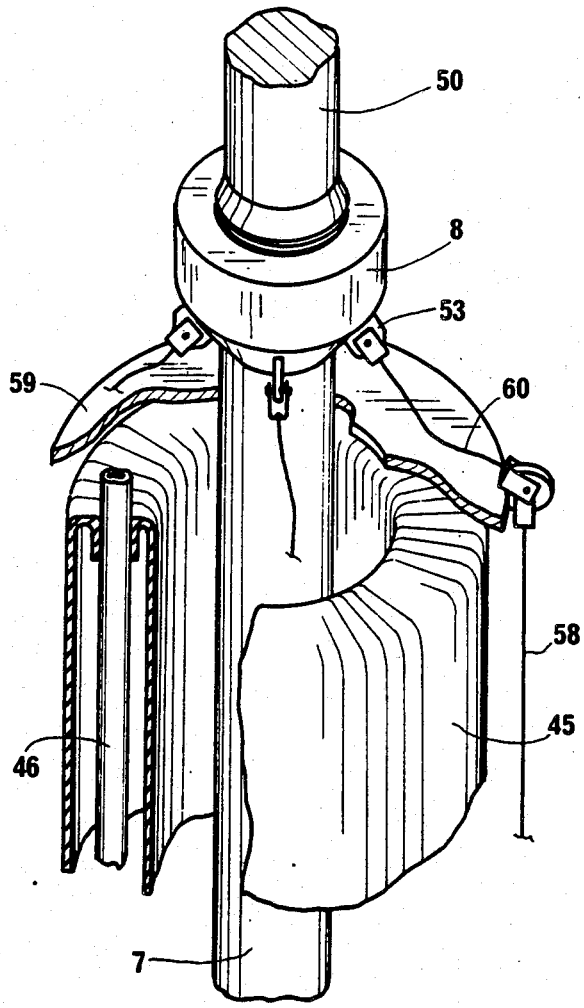
FIG. 3 is a close-up partly sectional pictorial view of part of the tether of FIG. 2.

The TLP of FIG. 1 comprises a platform 3 supported by four floats 4. On the ocean-bed are four hold-fast anchors 5. Tethers 6 (four at each corner, i.e. sixteen in all) extend from the platform 3 to the anchors 5. The platform 3 is jacked down the tethers 6, against the action of the floats 4, to create a permanent state of tension in the tethers 6. Such a construction provides a platform of great stability, which makes it a suitable construction for platforms that are to be left on the same site more or less permanently and an especially suitable construction where the water is very deep (of the order of 1500 m).

SOLID TETHER

Figure 2:
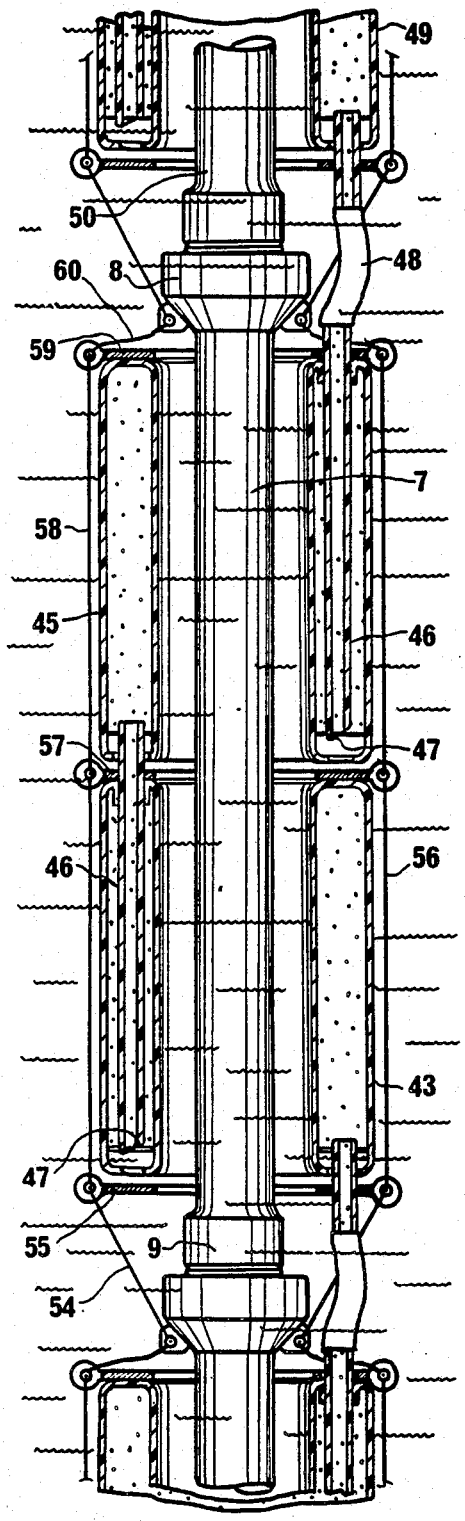
FIG. 2 is a sectional view of a section of a tether of the TLP of FIG. 1.

Part of one of the tethers 6 is shown in FIG. 2. A section 7 of the tether 6 is made of high-strength steel, and the section is shaped with a bulbous, female threaded, upper end 8, and a male threaded lower end 9. The remaining major portion of the length of the section is comparatively slender. (Typically its diameter is 300 mm and it will support a nominal tensile force of around 3000 tonnes).

The section 7 is provided with two donut-shaped buoyancy canisters 43, 45. The canisters 43, 45 are nominally identical, and each is closed at the top and open at the bottom. A tube 46 passes up the length of the canister and has a port 47 near the bottom of the canister. The tube 46 acts as a conduit to convey air that enters the port 47 upwards and into the next canister above. The tube 46 of the upper canister 45 is connected by a length of flexible hose 48 to the lower 49 of the two canisters associated with the next section 50 above.

Four lugs 53 are welded to the outside of a lower bulbous end 51 (where any stress concentration they cause will have no effect). Tensile cords 54 (typically made of polypropylene ) are attached to the lugs 53 with clevises. The other ends of these cords 54 are attached to lugs on a lower support frame 55. Further cords 56 extend from the lower support frame 55 to a middle support frame 57, and cords 58 extend from the middle support frame 57 to an upper support frame 59. Cords 60 extend from the upper support frame 59 to the lugs 53 of the upper bulbous end 8 of the tether section 7.

HOLLOW TETHER

Figure 4:
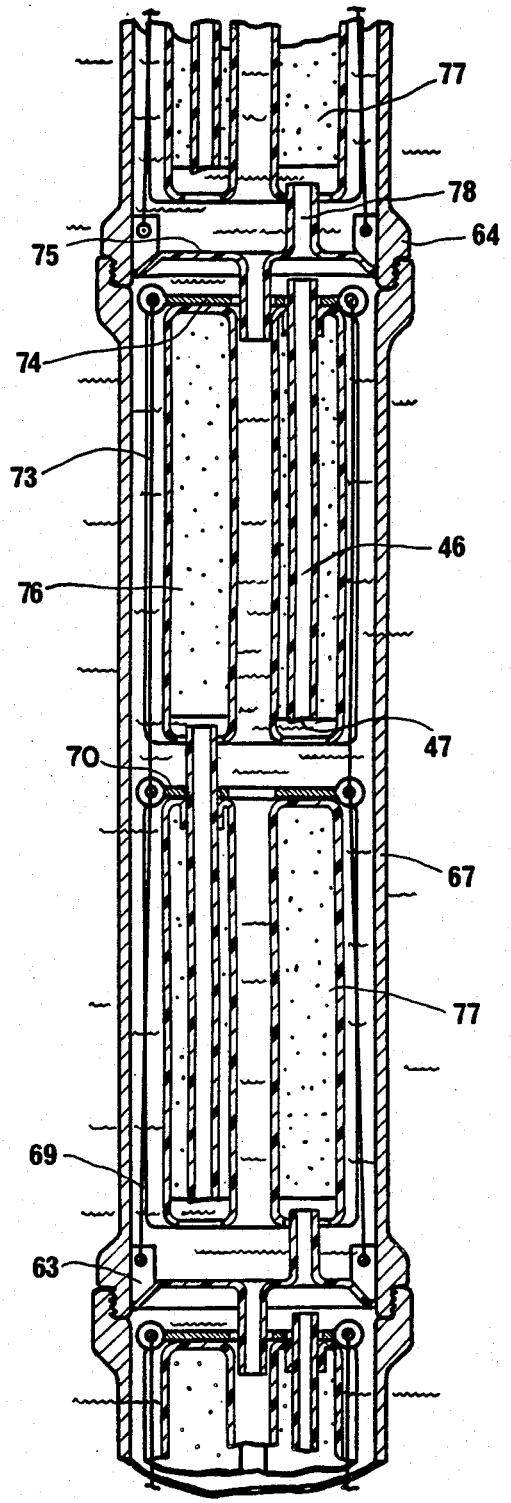
FIG. 4 is a sectional view of an alternative tether.

The tether may alternatively be hollow, with the canisters inside. Such a construction is shown in FIGS. 4, 5 and 6. Lugs 63 are welded inside the lower bulbous end 64 of a hollow section 65. This end 64 has a male thread which screws into the complementary female thread of the upper bulbous end 66 of a section 67 below, to the inside of which are welded some more lugs 68 (FIG. 5).

Cords 69 extend upwards from the lugs 63 to a middle support frame 70, and further cords 73 extend from there to the lugs 68. Upper 74, and lower 75 support frames (corresponding to the upper 59 and lower 55 support frames of the solid tether) are provided, but are now bolted firmly to the respective bulbous ends 66, 64. The upper frame 74 alternatively may be constrained only against upward movement by the tension cords 73, as shown in FIG. 4. Upper 76 and lower 77 donut shaped canister are provided as illustrated. The canisters are nominally identical.

The lower support frame 75 doubles as a collector plate in that it is shaped to act as a funnel for air that bubbles up from the tube 46 of the canister 76. The frame 75 includes a stubtube 78 which protrudes through a hole 79 in the canister 77. There are four holes 79, so that the canisters are effectively open at the bottom. It will be noted that the use of this aircollectionarrangement means that the canisters can be at any orientation relative to each other. There are holes 80 in the bulbous end 64 that are open to the sea to allow water to enter and leave the hollow interior of the sections.

DESCRIPTION OF THE TETHERS IN USE

The canisters are filled with air in the CASCAN manner referred to above, where air is fed into the lowermost canister at a high enough pressure to displace the water in the canister, (and water at a depth of 1500 m has a pressure of 150 atmospheres). Compressed air is conveyed to the lowermost canister through a hose, which in the hollow tether may pass down a passageway 81 concentric with the tether. The air fills that canister until it reaches the port 47, whence it flows up the tube 46 and starts to fill the canister above, and so on in cascade until all are filled with air. The pressure of the air in each filled canister is equal to the pressure of the water at the level of the respective port 47 appropriate to that canister.

In the case of the hollow tether, water displaced from inside the canisters flows out through the holes 80.

When the canisters contain water, and when they contain air but are out of the water, they rest, due to gravity, with canister 43 on support frame 55, 45 on 57, 76 on 70, and 77 on 75. When the canisters are filled with air they float upwards, with canister 43 against support frame 57, 45 against 59, 76 against 74, and 77 against 70. These support frames then become flotation abutments. No canister is called upon to transmit the buoyancy forces (or indeed the weight forces) of another canister, though the material of the canister and the forces are fed into the tether sections only at the bulbous ends of those sections. The canisters do not touch the coated surface of the slender part of the steel section.

If each section of the tether had to support the weight of all the sections below it, there would be no strength left in the upper sections to transmit the tension to the TLP. The deeper the water, the more sections there must be, and the worse this problem. With each section having a neutral buoyancy, however, virtually all the strength of the tether is available and usable to transmit the tension, practically without limit as to depth.

DEPLOYMENT OF A SOLID TETHER

Figure 7:
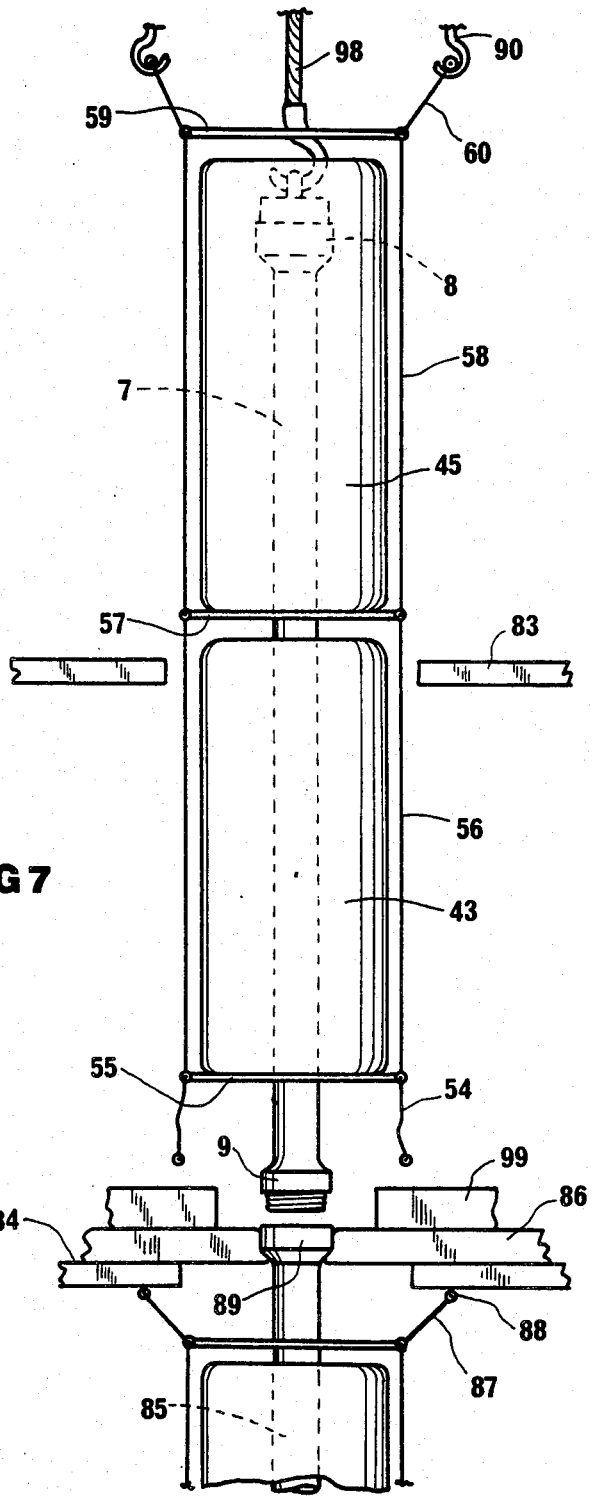
FIG. 7 is a diagrammatic view of the tether of FIG. 2 during deployment.

Turning now to FIG. 7, the deployment is carried out using upper 83 and lower 84 decks of a ship, or of the platform 3. Some already-assembled sections hang downwards, the top one 85 of those being gripped by jaws 86 mounted on the lower deck 84. The cords 87 of the buoyancy canisters of the section 85 are temporarily attached to hooks 88 in the deck 84, to leave access for the jaws 86 to grip the bulbous upper end 89 of the section 85.

A flotation assembly is put together on the upper deck 83, the assembly comprising upper and lower canisters, cords, and support frames having the same reference numerals as those in FIG. 2. The flotation assembly is picked up by a hoist 90 and positioned above, and concentric with, the section 85.

Next, the next section 7 is picked up from the store of sections by a crane 98 and lowered down though the centre of the donut shaped canisters. The lower end 9, after being inserted into the bulbous end 89 of the section 85, is gripped by another pair of jaws 99 which rotate the section 7 until it is tightly screwed to the section 85. Both sets of jaws 86, 99 are then withdrawn so that the whole strut is now hanging from the crane 98. The cords 87 are released from the hooks 88 and attached to lugs on the end 89, as are the loosely hanging cords 54; the crane 98 lowers the whole strut, the hoist 90 being lowered in unison, through a distance equal to the length of one section. The cords 60 are released from the hoist 90 and attached to hooks 88; the jaws 86 are fastened to the upper end 8 of the section; the crane 98 is released; and the whole cycle may begin again with the next section.

It will be seen that assembly of the steel sections and of the buoyancy assemblies proceeds to an extent in parallel. The whole deployment operation is characterised by simplicity and speed. The components are all the same, section to section, which makes for easy logistics. If the water is very deep though, the air at that depth is compressed so much that the density of the air itself can no longer be neglected. Hence, the canisters destined for very deep use may need to have a somewhat increased air capacity to make the buoyancy truly neutral.

CONSTRUCTION OF CANISTER

The canisters have to be inexpensive to manufacture, yet highly reliable in use. Any non-homogeneities in the material, or voids, or inclusions, or other defects, must be kept within very tight control. An acceptable material has been found to be cross-linked polyethylene.

It is preferable for the purposes of the invention to form the canister by slow-rotational moulding. This method has the advantage of not only producing a dense, homogeneous, material, but also of giving rise to a self-thickening of the material at corners and joins, without the tendency to chill-stress that can occur at shape-changes with some moulding methods.

What is claimed is:

1. Apparatus for transmitting forces between two points that are widely separated vertically in a body of deep water, the apparatus comprising a strut, and buoyancy means for supporting the weight of the strut, characterised by the following structural combination:

(a) the strut is in sections that are fastened end to end, and a section of the strut has a relatively slender form over most of its length, but is relatively bulbous at at least one of its ends;

(b) the buoyancy means comprises a plurality of vertically stacked air canisters, to which air is fed in a cascading fashion from the bottom-most canister upwards;

(c) each canister has a vertical height of less than half the length of a section of the strut, and two or more canisters disposed one above the other are provided for each strut section;

(d) wherein the buoyancy forces from the canisters along the entire length of the strut are transmitted to the strut by cords on all the strut sections, which cords are capable of transmitting only tensile forces;

(e) wherein there are cord attachment points at the at least one bulbous end of each strut section, and the cords extend from cord attachment means provided on each canister to the next lower cord attachment point along the length of the strut; and (f) wherein each canister and cord is spaced laterally from the respective strut section where it is disposed along the length of the relatively slender form of that strut section.

2. Apparatus of claim 1, wherein a flotation abutment plate is provided for each canister, the abutment plate being located above the canister and arranged to constrain the canister against upwards movement, and each said abutment plate is spaced laterally from the respective strut section at the point where it is located along the length of the relatively slender form of the strut section.

3. Apparatus of claim 2, wherein each strut section is provided with upper and lower canisters and upper and middle abutment plates; the upper abutment plate being located above the upper canister, and the middle abutment plate being located between the upper and lower canisters; and wherein cords extend from the middle abutment plate down to the bulbous end of the strut section at the bottom thereof, and from the upper abutment plate down to the middle abutment plate.

4. Apparatus of claim 3, wherein cords extend from the upper abutment plate to a bulbous end at the top of a strut section.

5. Apparatus of claim 3 wherein the upper abutment plate is firmly and rigidly fixed to a bulbous end at the top of a strut section.

6. Apparatus of claim 3, including a support frame placed below the lower canister and capable of supporting the weight of the lower canister when the canister is out of the water.

7. Apparatus of claim 6, wherein the support frame and the flotation abutment are nominally identical.

8. Apparatus of claim 1, wherein a canister in plan view is donut shaped, and wherein the inner diameter of the donut is large enough to pass over the bulbous end of a strut section.

9. Apparatus of claim 8, wherein the canister defines an air-space which extends substantially entirely around a strut section.

10. Apparatus of claim 1, wherein each strut section is hollow, and the canisters are disposed inside it.

11. Apparatus of claim 10, wherein a canister defines an air-space which extends substantially entirely around a strut section.

12. Apparatus of claim 4 including a support frame placed below the lower canister and capable of supporting the weight of the lower canister when the canister is out of the water.

13. Method of deploying buoyancy supported struts in deep water, where each buoyancy supported strut is defined as follows:

(a) the strut is in sections that are fastened end to end, and a section of the strut has a relatively slender form over most of its length, but is relatively bulbous at at least one of its ends;

(b) the buoyancy means comprises a plurality of vertically stacked air canisters, to which air is fed in cascading fashion from the bottom-most canister upwards;

(c) each canister has a vertical height of less than half the length of a section of the strut, and two or more canisters disposed one above the other are provided for each strut section;

(d) wherein the buoyancy forces from the canisters along the entire length of the strut are transmitted to the strut by cords on all the strut sections, which cords are capable of transmitting only tensile forces;

(e) wherein there are cord attachment points at the at least one bulbous end of each strut section, and the cords extend from cord attachment means provided on each canister to the next lower cord attachment point along the length of the strut; and (f) each canister and cord is spaced laterally from the respective strut section over the length of its relatively slender form;

wherein a flotation abutment plate is provided for each canister, the abutment plate being located above the canister and arranged to constrain the canister against upwards movement, and each said abutment plate is spaced laterally from the respective strut section at the point where it is located along the length of the relatively slender form of the strut section;

wherein each strut section is provided with upper and lower canisters and upper and middle abutment plates, the upper abutment plate being located above the upper canister, and the middle abutment plate being located between the upper and lower canisters; and wherein cords extend from the middle abutment plate down to the bulbous end of the strut section at the bottom thereof, and from the upper abutment plate down to the middle abutment plate;

wherein cords extend from the upper abutment plate to a bulbous end at the top of a strut section;

and wherein a support frame is placed below the lower canister and capable of supporting the weight of the lower canister when the canister is out of the water;

where the method comprises the steps of:

supporting a lower section by means of jaws about an upper bulbous end of that section;

assembling a flotation assembly of canisters, abutments, and cords;

suspending the flotation assembly over the lower section by means of a hoist;

lowering the next section down through the centre of the flotation assembly with a crane;

attaching the said two sections together;

releasing the jaws;

lowering the sections with the crane, and the flotation assembly in unison with the hoist;

attaching the lower end of the flotation assembly at the lower end of its respective section; and repeating the above sequence of steps until the strut is complete.

14. Method of claim 13, wherein the strut sections are screwed together.

15. A tension leg platform having a plurality of tethers, where each tether comprises:

apparatus for transmitting forces between two points that are widely separated vertically in a body of deep water, the apparatus comprising a strut, and buoyancy means for supporting the weight of the strut, characterised by the following structural combination:

(a) the strut is in sections that are fastened end to end, and a section of the strut has a relatively slender form over most of its length, but is relatively bulbous at at least one of its ends;

(b) the buoyancy means comprises a plurality of vertically stacked air canisters, to which air is fed in a cascading fashion from the bottom-most canister upwards;

(c) each canister has a vertical height of less than half the length of a section of the strut, and two or more canisters disposed one above the other are provided for each strut section;

(d) wherein the buoyancy forces from the canisters along the entire length of the strut are transmitted to the strut by cords on all the strut sections, which cords are capable of transmitting only tensile forces;

(e) wherein there are cord attachment points at the at least one bulbous end of each strut section, and the cords extend from cord attachment means provided on each canister to the next lower cord attachment points on a bulbous along the length of the strut; and (f) wherein each canister and cord is spaced laterally from the respective strut section where it is disposed along the length of the relatively slender form of that strut section.

* * * * *